United States Patent [19]

Hsu et al.

[11] Patent Number: 4,598,898

[45] Date of Patent: Jul. 8, 1986

[54] ELECTRICAL HYDRAULIC JACK

[76] Inventors: Wen-Cheng Hsu, 2, Alley 15, Lane 229, Kwang-Hua St.; Chin-Jia Wu, 225, Min-Chuan Rd.; Shuen-Liang Kuo, 31, Lane 7, Shan-Kuan Rd., all of Tainan City, Taiwan

[21] Appl. No.: 578,217

[22] Filed: Feb. 8, 1984

[51] Int. Cl.[4] ..... B66F 3/24

[52] U.S. Cl. ..... 254/93 H; 254/1

[58] Field of Search ..... 254/93 H, 1, DIG. 2

[56] References Cited

U.S. PATENT DOCUMENTS

| | | | |
|---|---|---|---|
| Re. 26,846 | 4/1970 | Weiss | 254/1 |
| 2,034,605 | 3/1936 | Carman | 254/93 H |
| 2,420,910 | 5/1947 | Richards | 254/93 H |
| 2,458,590 | 1/1949 | Harris et al. | 254/1 |
| 4,077,608 | 3/1978 | Nehrig | 254/93 H |

*Primary Examiner*—Frederick R. Schmidt

*Assistant Examiner*—Steven P. Schad

*Attorney, Agent, or Firm*—Finnegan, Henderson, Farabow, Garrett & Dunner

[57] ABSTRACT

An improved electrical hydraulic jack of the type having of a jack body with a lift structure and a manually adjustable crown rod telescopically disposed therein, a base plate integrally formed to the jack body, a motor assembly matched with a housing body fixed on the base plate in upright position, wherein the improvement comprises a transmission device installed in the upper portion of the housing body in connection with the motor assembly, and a driving device mechanically coupled between the transmission device and the jack body, thereby, the high revolution of the motor assembly will be reduced, and the revolving motion will be converted into straight line movement for effecting hydraulic lift operation therewith.

1 Claim, 4 Drawing Figures

ELECTRICAL HYDRAULIC JACK

BACKGROUND OF THE INVENTION

This invention relates to an electrical hydraulic jack, particularly to that type having improved transmission and driving mechanisms for simplifying the structure and facilitating operations.

Conventionally, jacks are usually classified into two types—the screw type and the hydraulic type. The former is seldom used today while the latter prevails in the mechanic field and presents with various designs among which the electrically actuated hydraulic jack is the one widely accepted by the users concerned with this device. However, the known electrical hydraulic jacks usually have a complicated structure which suffers not only a high manufacturing cost but also an inconvenient operation. Typical hydraulic jack of this kind is U.S. Pat. No. 2,034,605, which has a telescopic lift strut structure matched with a motor driving mechanism for being electrically actuated through the power source of the motor vehicle. However, the configuration of this known hydraulic jack is much complicated, and the structure is bulky, not convenient for practical use.

SUMMARY OF THE INVENTION

It is accordingly a primary object of this invention to provide an improved electrical jack with simplified structure for overcoming the problems suffered by the prior art.

According to the present invention, this and other objects are achieved by providing an improved electrical hydraulic jack, which includes: a jack body having a hydraulic lift structure and manually adjusting device telescopically disposed therein; and a motor assembly having a transmission mechanism and a driving mechanism matched therewith mechanically connected to the jack body for being electrically operated through the power source of the motor vehicle; thereby, not only the structure of the hydraulic jack is much simplified but also the operation is more practical and convenient than that of the prior art.

Further characteristics and advantages of this invention will become apparent from the following description of one example of a preferred but not sole form of embodiment for this invention, given below with reference to the accompanying drawings.

DETAILED DESCRIPTION OF THE PREFERRED EMBODIMENT

Figure 1:
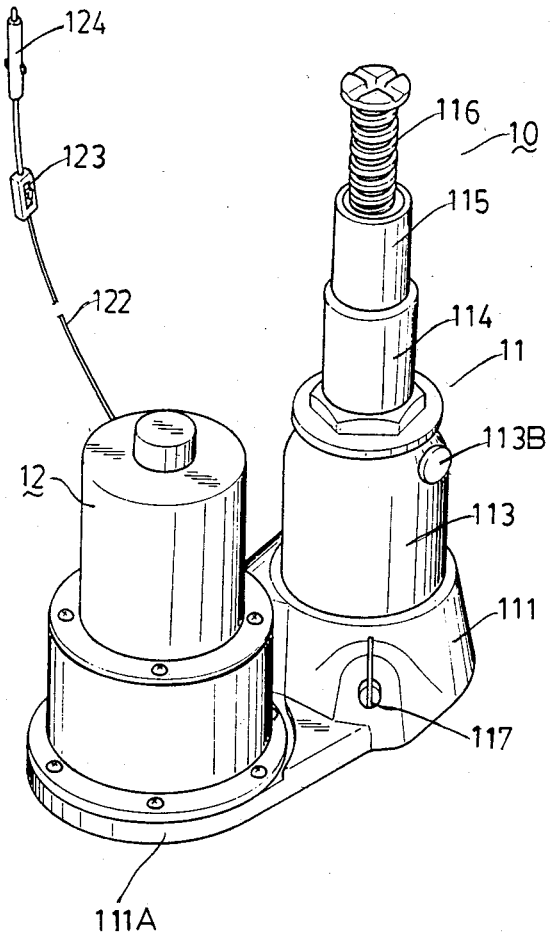
FIG. 1 is a three-dimensional view of a preferred embodiment of an improved electrical hydraulic jack according to this invention.
Figure 2:
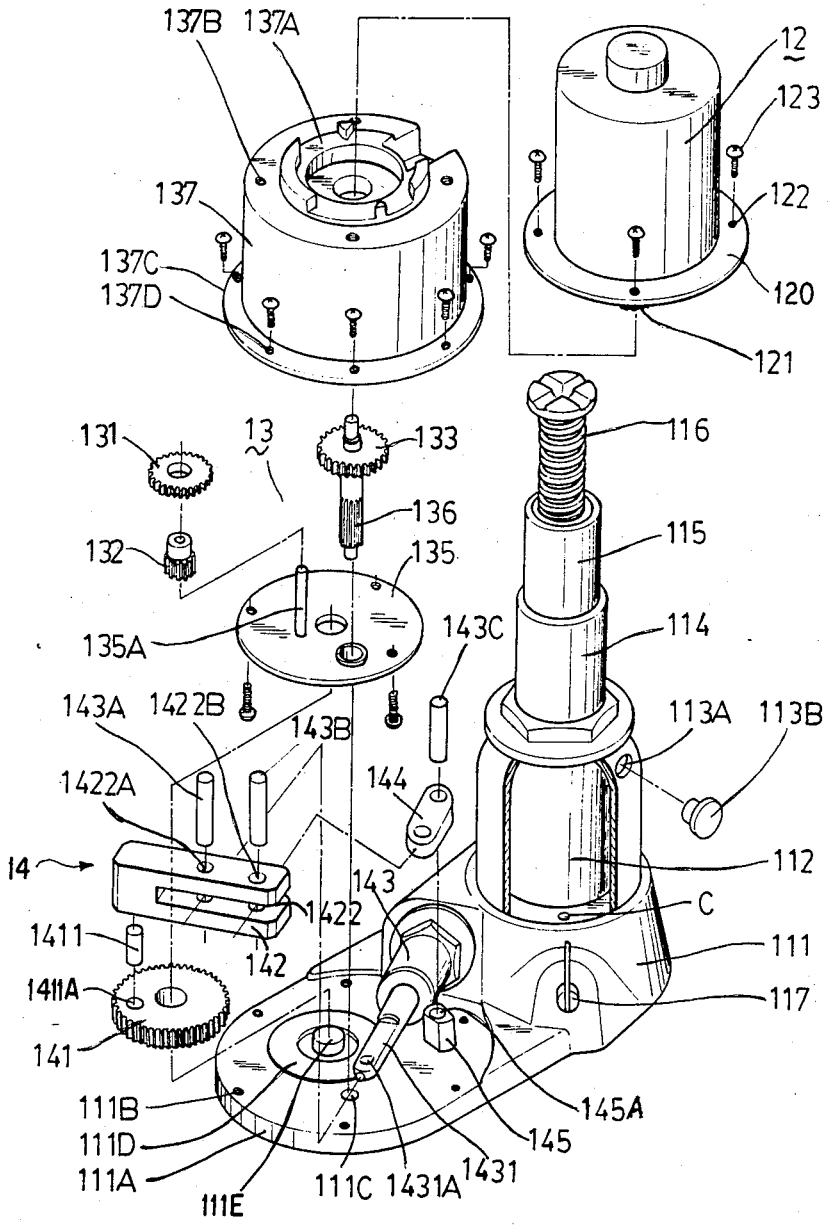
FIG. 2 is an exploded view of the preferred embodiment shown in FIG. 1.

Referring to FIGS. 1 and 2, there is shown a preferred embodiment of an improved electrical hydraulic jack according to this invention, which hydraulic jack 10 includes in combination a jack body 11, a motor assembly 12 having a transmission mechanism 13 and a driving mechanism 14 coupled therewith functionally connected to the jack body 11 for effecting automatic lift operation.

The jack body 11 includes: a hollow base 111 having an open section in the upper portion; a cylindrical body 112 provided in upright position in the top of the open section of the hollow base 111; an outer cover 113 having an oil filler 113A formed in the upper portion secured around the periphery of the cylindrical body 112 on the top edge of the hollow base 111 in defining an oil storage chamber therein; a filler cap 113B provided in conjunction with the oil filler 113A; and a telescopic lift structure combined by a first cylinder 114 movably disposed in the cylindrical body 112, a second cylinder 115 slidingly arranged in the first cylinder 114, and a threaded crown rod 116 adjustably installed in the second cylinder 115, provided in the top of the outer cover 113 in connection with the oil storage chamber defined by the cylindrical body 112 and the outer cover 113. The first cylinder 114 and second cylinder 115 are to be actuated by the hydraulic stored in the oil storage chamber defined by the cylindrical body 112 and the outer cover 113 while the threaded crown 116 is manually adjustable for compensating the lifting height of the cylinders 114 and 115 when the lift operation requires. After the hydraulic oil is filled into the oil storage chamber from the oil filler 113A, the filler cap 113B is then secured in the oil filler 113A for preventing the oil from being leaked thereat. In addition, the hollow base 111 has an opening C formed in the base wall as shown in communication with an oil passage integrally provided therein (not shown) for permitting the oil thereof to flow into the hollow section of the base 111. A release valve 117 is provided in the base 111 in conjunction with the oil passage and the opening C for controlling the flow of the oil. It shall be appreciated that the structural and operational principles of the jack body 111 are the same as that of the prior art.

As shown in FIG. 2, the motor assembly 12 has an external gear portion 121 formed on the lower end of the motor shaft, a flange 120 around the lower edge and a plurality of screw holes 122 formed in the flange 120. A housing body 137 having a fitting seat 137A in the top portion with an opening in the middle, a plurality of screw holes 137B in the top edge, a flange 137C around the lower edge with a plurality of screw holes 137D formed therein is coupled with the motor assembly 12 and fixed by a plurality of screws 123 through the screw holes 122 aligned with the screw holes 137B of the housing body 137. A power line 122 (as shown in FIG. 1) having control switch 123 and a plug 124 connected to the motor assembly 12 for being plugged into the lighter of the car. A transmission mechanism 13 which is combined by a first gear 131, a pinion 132 coupled with first gear 131, a second gear 133 with a toothed stem 136, and a shielding plate 135 with an upright strut 135A and a plurality of openings integrally formed therein, is installed in the middle portion of the housing body 137 wherein the first gear 131 is meshed with the external gear protion 121 of the motor assembly 12 while the pinion 132 is meshed with the second gear 133 of which the toothed portion 136 extends downward through an opening of shielding plate 135 fixed in the middle portion of the housing body 137. With the arrangement of transmission mechanism 13, the high revolution of the motor assembly 12 is reduced to a proper low revolution through the coupling of the first gear 131, the pinion 132 and the second gear 133. A driving mechanism 14 which is combined by a revolving gear 141, an offset driven member 142, a piston body 143 and a linking-up member 144, is installed in the lower portion of the housing body 137 of which the flange 137C is fastened on a base plate 111A through the screw holes 137D and the screw holes 111B.

Figure 3:
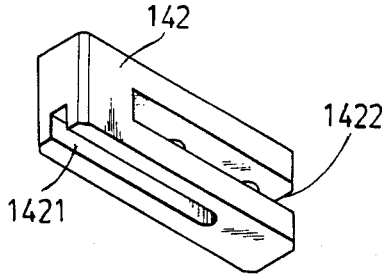
FIG. 3 is an isometric view of an offset driven member disposed in the driving mechanism of the preferred embodiment shown in FIG. 2.
Figure 4:
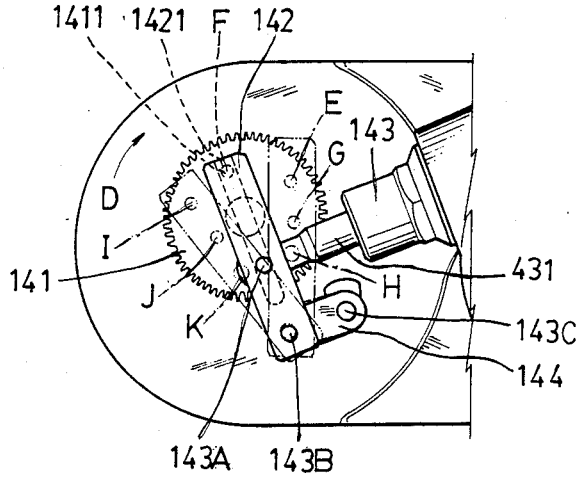
FIG. 4 is an operational illustration of the driving mechanism of the preferred embodiment shown in FIG. 2.

The base plate 111A includes: a blind opening 111C where the lower end of the second gear 133 is rotatably positioned; a supporting seat 111D with a dead axle stud 111E around which the revolving gear 141 is rotatably located and meshed with the toothed portion 136 of the second gear 133; and a fixed stub 145 having an opening 145A in the top provided adjacent to the piston body 143. The offset driven member 142 as shown in FIG. 3 includes a sliding groove 1421 and a cut-through opening 1422 formed therein with a pair of orifices 1422A and 1422B formed in one side through the opening 1422. The piston body 143 includes a piston portion installed in the hollow base 111 in connection with the cylindrical body 112 and the oil storage chamber thereof, and a piston rod 1431 having an orifice 1431A at one end extending therefrom for being movably secured in the cut-through opening 1422 by a locating pin 143A through the orifices 1422A and 1431A aligned thereat. A driving pin 1411 is secured in an opening 1411A of the revolving gear 141 at one end with the other end movably received in the sliding groove 1421. The linking-up member 144 is movably connected between the driven member 142 at one end by a locating pin 143B through the orifice 1422B and the fixed stub 145 at the other end by a locating pin 143C movably positioned in the opening 145A as shown in FIG. 4. It shall be appreciated that the piston portion installed in the base 111 includes a pair of oil passages respectively communicating with the inner portion of the cylindrical body 112 and the oil storage chamber defined thereof, and a unilateral check valve is provided in each of the oil passages of the piston portion. As the structure and operation of the piston body 143 are of a known art, details of description and illustration are therefore omitted for clarity.

The completed assembly of the preferred embodiment described above and illustrated in FIGS. 2 and 3 is as shown in FIG. 1 while the related operational positions of the driving mechanism 14 matched with the piston rod 1431 and the linking-up member 144 are illustrated in FIG. 4. When the motor of the motor assembly 12 starts running, its revolution is transmitted to the first gear 131 through the external gear portion 121 of the motor shaft and then relayed to the second gear 133 with reduced speed through the pinion 132 meshed with the second gear 133. As the toothed portion 136 of the second gear 133 is meshed with the revolving gear 141, the driving mechanism 14 will also start to run but in reduced speed along with the revolving gear 141 which is rotated in direction D as shown in FIG. 4. In this condition, the driving pin 1411 will be pushed to move back and forth in the sliding groove 1421 of the driven member 142 so that the driven member 142 is forced to swing backward and forward thereat as the dotted lines shown in FIG. 4, making the piston rod 1431 to move in and out in straight line in the piston portion and thereby effect the hydraulic lift operation thereat. Details are as follows:

As shown in FIG. 4, when the revolving gear 141 is driven to rotate in the direction D, the driving pin 1411 will be forced to slide in the sliding groove 1421 of the driven member 142 from position F to position H through positions E and G. At this time the driven member 142 is pushed to the outmost limit against the piston rod 1431 which is driven into the piston body 143 in effecting hydraulic pumping operation; while, when the revolving gear 141 continues to rotate in the same direction, the driving pin 1411 starts to move from position H to position I through positions K and J along with the rotation of the revolving gear 141 so as to pull the piston rod 1431 out of the piston body 143. As the driven member is moved to the other outmost limit, the driving pin 1411 then returns from position I to position F for repeating the first movement in the sliding groove 1421 so that the driven member 142 is reciprocally pushed back and forth against the piston rod 1431 in accomplishing lift operation through jack body 11. Since the hydraulic jack operation performed by the piston body 143 is similar to that of the prior art, detailed description is omitted for clarity.

While the invention has been particularly shown and described with reference to a preferred embodiment thereof, it will be understood by those skilled in the art that various changes in form and details may be made therein without departing from the spirit and scope of the invention.

What is claimed is:

1. An improved electrical hydraulic jack having a base plate with a supporting seat and a hollow section formed thereon, a jack body provided with a piston assembly installed in the hollow section of the base plate, and a motor assembly having an external gear portion, a housing body having a fitting seat in a top portion thereof with a central opening formed therein and adapted to coupling with the motor assembly having said external gear portion extending into said housing body, a transmission coupled with the motor assembly for transmitting and reducing revolution speed of the motor assembly, driving means mechanically connected to said transmission and the piston assembly for converting revolving motion of said motor assembly into a straight-line movement, said driving means comprising a revolving gear having a plurality of openings rotatably disposed on a dead axle stud and meshed with a toothed stem of a second gear of the transmission, a driving pin having one end thereof installed in an opening of said revolving gear, an offset driven member having a sliding groove in one side, a middle cut-through opening, and a pair of orifices in an other side opposite said side having said sliding groove, said cut-through opening being disposed over said revolving gear with an other end of said driving pin movably positioned in the sliding groove of said driven member, and a free end of a piston rod of the piston assembly located in said cut-through opening, said driven member having first and second locating pins, said first locating pin connecting an end of the piston rod to said driven member in the cut-through opening through one orifice thereof, and a linking-up member having a pair of orifices formed therein and movably connected to a fixed stub through a third locating pin at one end and to said offset driven member through said second locating pin at an other end, whereby the revolving motion applied by the motor assembly will be converted into a straight line movement to effect hydraulic lift operation.

* * * * *